US006065863A

United States Patent [19]

Cain

[11] Patent Number: 6,065,863

[45] Date of Patent: May 23, 2000

[54] SYSTEM FOR MIXING BULK WINDSHIELD WASHER LIQUID FOR BOTH COLD AND WARM CLIMATES

[75] Inventor: William O. Cain, Portage, Mich.

[73] Assignee: Solvent Solutions, Inc., Battle Creek, Mich.

[21] Appl. No.: 09/012,483

[22] Filed: Jan. 23, 1998

Related U.S. Application Data

[60] Provisional application No. 60/043,104, Apr. 17, 1997.

[51] Int. Cl.[7] ..... B01F 15/02; B01F 15/04

[52] U.S. Cl. ..... 366/163.2; 366/177.1; 366/182.3

[58] Field of Search ..... 366/152.2, 153.1, 366/160.1, 162.1, 163.2, 177.1, 182.1, 182.3, 182.4; 222/145.1; 137/393, 544, 625.4, 602, 888, 896, 897

[56] References Cited

U.S. PATENT DOCUMENTS

| | | | |
|---|---|---|---|
| 1,647,473 | 11/1927 | Rushmore | 366/163.2 |
| 2,724,581 | 11/1955 | Pahl et al. | 366/182.1 |
| 3,807,701 | 4/1974 | Reid et al. | 366/153.1 |
| 3,976,087 | 8/1976 | Bolton et al. | 366/163.2 |
| 4,468,127 | 8/1984 | Agosta | 366/160.1 |
| 4,573,802 | 3/1986 | Kerrigan et al. | 366/162.1 |
| 5,171,090 | 12/1992 | Wiemers | 366/163.2 |
| 5,466,063 | 11/1995 | Poyet et al. | 366/163.2 |
| 5,632,960 | 5/1997 | Ferri, Jr. et al. | 366/152.2 |

FOREIGN PATENT DOCUMENTS

| | | | |
|---|---|---|---|
| WO 94/29011 | 12/1994 | WIPO | 366/163.2 |

*Primary Examiner*—Tony G. Soohoo

*Attorney, Agent, or Firm*—Flynn, Thiel, Boutell & Tanis, P.C.

[57] ABSTRACT

A system for mixing bulk windshield washer liquid for both cold and warm climates utilizing a pair of mixers and means for selectively actuating these mixers. A high concentrate educator is used to mix the warm weather mixture and a high volume eductor is used to mix the cold weather mixture. A three way water valve is used to direct water to the high concentrate eductor and to the high volume eductor. A float valve is used to maintain an essentially constant level of windshield washer liquid within the system. Detergent and alcohol are drawn from their respective storage containers solely in response to fluid flow through the eductors, thereby eliminating the need for electrical pumps or metering equipment.

27 Claims, 1 Drawing Sheet

SYSTEM FOR MIXING BULK WINDSHIELD WASHER LIQUID FOR BOTH COLD AND WARM CLIMATES

RELATED APPLICATION

This application claims the benefit of U.S. Provisional Application No. 60/043,104 filed Apr. 17, 1997, which is incorporated herein by reference.

BACKGROUND AND SUMMARY OF THE INVENTION

This invention is related to systems for mixing bulk quantities of windshield washer liquid and more particularly to a system for mixing bulk quantities of windshield washer liquid for both cold and warm climates that allows the system to be quickly and easily switched between producing a cold weather formulation and a warm weather formulation of windshield washer liquid.

Windshield washer fluid is used to clean the windshield of a motor vehicle while the motor vehicle is being driven. During the warmer months of the year, the windshield washer fluid is used primarily to remove insect matter, dirt and debris. During the colder months of the year, the windshield washer fluid is used primarily to de-ice the windshield and to remove salt residue. Windshield washer fluid is typically a water-based mixture that may contain one or more water-soluble alcohols to depress the freezing point of the mixture and detergents or surfactants to increase the cleaning efficiency of the solution.

Motor vehicle service centers, such as oil change centers, vehicle maintenance garages, or automobile dealership maintenance facilities, typically purchase bulk quantities of windshield washer liquid concentrates and mix these concentrates with water at the individual facilities to produce the windshield washer liquid that is dispensed into motor vehicles as they are being serviced. Purchasing bulk quantities of windshield washer liquid concentrates results in substantial savings in material costs, shipment costs, and storage costs compared to purchasing pre-mixed windshield washer liquid.

Windshield washer liquid concentrates are typically mixed with water in a storage tank prior to being dispensed into the motor vehicles. In some cases, a measured quantity of concentrate is manually added to a storage container and the container is manually filled with water to create the concentrate/water mixture. With this type of system, the resulting liquid may be less than uniformly mixed and the quantity of concentrate required to produce a given concentrate/water ratio will have to be determined each time if the container is not empty when the mixture is being prepared. It is advantageous, of course, to have pre-mixed windshield washer fluid on hand at all times and not to completely empty the container between fillings. The containers used with manual mixing are often large, such as 550 gallon capacity tanks, and these tanks take up significant floor space.

A better system for mixing the water and windshield washer liquid concentrates utilizes a device called an eductor. The eductor has two inlet ports, one for the primary liquid being mixed, such as water, and the other for the secondary liquid being mixed, such as windshield washer liquid detergent concentrate, and a single outlet port for the mixture of these liquids. When the primary liquid flows from its inlet port to the outlet port, the venturi effect creates a suction force at the secondary liquid inlet port. This suction force causes a regular, metered amount of the secondary liquid to mix with the primary liquid within the educator and to exit the outlet port. Eductors often have replaceable or adjustable metering tips which allow the secondary liquid flow to be regulated and thereby allow the primary liquid/secondary liquid ratio of the output mixture to be varied.

In many parts of the United States, service centers use two distinctly different formulations of windshield washer liquid, a warm weather mix and a cold weather mix. The warm weather mix typically consists of a relatively small proportion of concentrated detergent and relatively large amount of water. The warm weather formulation is optimized to effectively remove the types of windshield contaminates common during warmer weather, such as insect matter, dirt and debris.

The cold weather mix typically consists of a substantial proportion of water-soluble alcohols, a smaller proportion of detergent, and water. As discussed above, water-soluble alcohols, such as methanol, ethanol, propanol, and ethylene glycol, are primarily used to depress the freezing point of the solution. It is critical to avoid having the windshield washer fluid freeze within the vehicle during the coldest months of the year. The windshield washer fluid dispensing system is a critical safety component in a motor vehicle because it allows the vehicle operator to clean the windshield if visibility becomes impaired while the motor vehicle is being driven. The dispensing system cannot perform this essential function if ice crystals form in the windshield washer fluid and clog the tubing or orifices of the dispensing system. The components of the dispensing system can also be damaged or destroyed if the windshield washer fluid becomes frozen. The cold weather formulation is therefore designed to prevent the freezing of the windshield washer fluid, even under the most extremely cold conditions likely to be encountered by the vehicle.

The amount of water-soluble alcohol in the windshield washer liquid mixture may be varied depending on the season. A ten percent (10%) methanol mixture may be acceptable for solutions dispensed in the early fall and the late winter, but a late fall or early winter mixture may require a twenty-five percent (25%) methanol mixture. Cold weather formulations may contain up to forty percent (40%) methanol. As discussed above, a warm weather formulation dispensed during the spring or summer may not include any methanol or other water-soluble alcohol.

To produce the cold weather windshield washer liquid formulation, a relatively large proportion of water-soluble alcohol and a relatively small proportion of detergent must be added to water. If an eductor is used to produce the cold weather mixture, the eductor used to mix the alcohol and water must be a high volume eductor (i.e. it must be capable of admixing relatively large quantities of alcohol with the water passing through the eductor), in contrast to the high concentrate eductor used to produce the warm weather windshield washer liquid mixture, which is only required to admix relatively small quantities of warm weather concentrate with the water passing through the eductor. A high volume educator can be used to produce an alcohol/water mixture that contains as much as 40% alcohol, while a high concentrate eductor may be used to produce a detergent/water mixture where the detergent may be diluted at a 1200 to 1, or even higher, ratio.

While premixed cold weather concentrates may be purchased that contain blended alcohol and detergent, it is typically more cost effective to purchase separate bulk containers of alcohol and detergent. Purchasing separate containers of alcohol and detergent also allows the alcohol concentration and detergent concentration in the cold weather mixture to be individually set by the operator of the mixing system.

Facilities that mix their own windshield washer fluid from concentrate and that alternate between using a warm weather formulation and a cold weather formulation have not, heretofore, had automatic mixing equipment designed to be capable of quickly and easily switching from a warm weather mode of operation to a cold weather mode of operation, and vice versa.

The inventive system allows two distinctly different types of windshield washer fluid mixtures to be produced and allows the type of mixture produced by the system to be changed merely by repositioning the handles on a pair of three way valves.

A three way water valve is connected to pair of eductors, a first high concentrate eductor that is used to produce the warm weather mixture and a high volume eductor that is used to produce the cold weather mixture. A three way detergent valve is connected to the first high concentrate eductor used to produce the warm weather mixture and to a second high concentrate eductor that mixes the detergent with the alcohol before the alcohol/detergent mixture is mixed with water in the high volume eductor to produce the cold weather mixture. Each of the eductors have metering tips which allow the ratio of primary liquid to secondary liquid to be regulated. The alcohol feed line also incorporates a metering valve which allows the composition of the winter weather mixture to be further regulated.

The three way water valve is connected to a water supply pipe having a shutoff valve that allows or prohibits water from entering the system, a float valve that maintains a constant level of windshield washer liquid within the holding tank, and a check valve that prevents detergent or alcohol from entering the water supply pipe.

The three way valves are located within a housing that acts as a holding tank for the mixture discharged from the eductors. A drain located on the bottom of the holding tank is connected to a pump which pumps the windshield washer liquid to a servicing locating where it can be dispensed into the windshield washer liquid reservoirs of motor vehicles. The alcohol feed line is connected by a supply line that terminates at the bottom of a sealed alcohol container. A vent pipe connects the headspace on the top of the alcohol container to the headspace on the top of the housing. A passageway allows the vapors in the headspace of the housing to pass through an activated charcoal filter before they escape the system. The vent pipe allows air to enter the sealed alcohol container as the level of alcohol in the container drops and allows fumes from the alcohol to reach the activated charcoal filter, where they can be neutralized before being discharged into the building in which the system is located. A removable cover inhibits evaporation when the cover is in the closed position and allows an operator to access the internal components of the system to reposition the handles of the three way valves, to adjust the metering valve, or to replace the metering tips when the cover is in the open position.

In use, the level of windshield washer liquid in the holding tank is regulated by the float valve and the holding tank is automatically refilled as the windshield washing fluid is dispensed. When the detergent or alcohol containers being used are emptied, the operator merely removes the applicable supply line (and the vent pipe in the case of the alcohol container), removes the empty container, places a full container of detergent or alcohol in the proper position and reconnects the supply line (and the vent pipe in the case of the alcohol container). If the metering tips and the metering valve connected to the educters are properly adjusted, the only action required to switch the system from the summer mode to the winter mode, or vice versa, is to reposition the handles on the three way water valve and the three way detergent valve to the opposite positions and to make sure that the appropriate containers are properly connected to the system.

The preferred embodiment of the disclosed system withdraws the detergent and alcohol and produces windshield washer liquid utilizing only the hydraulic force of the water entering the housing from the water supply line. An air driven pump is used to pump the windshield washer liquid to the appropriate dispensing locations, which allows the inventive system to mix and dispense windshield washer liquid without the use of electrical motors or electrical circuits. This is particularly advantageous because many alcohols that can be used to produce the cold weather mixture, such as methanol, are flammable and eliminating electrical motors and electrical circuits eliminates possible ignition sources.

Further objects, features and advantages of the invention will become apparent from a consideration of the following description when taken in connection with the accompanying drawing.

DETAILED DESCRIPTION OF THE PREFERRED EMBODIMENT

Figure 1:
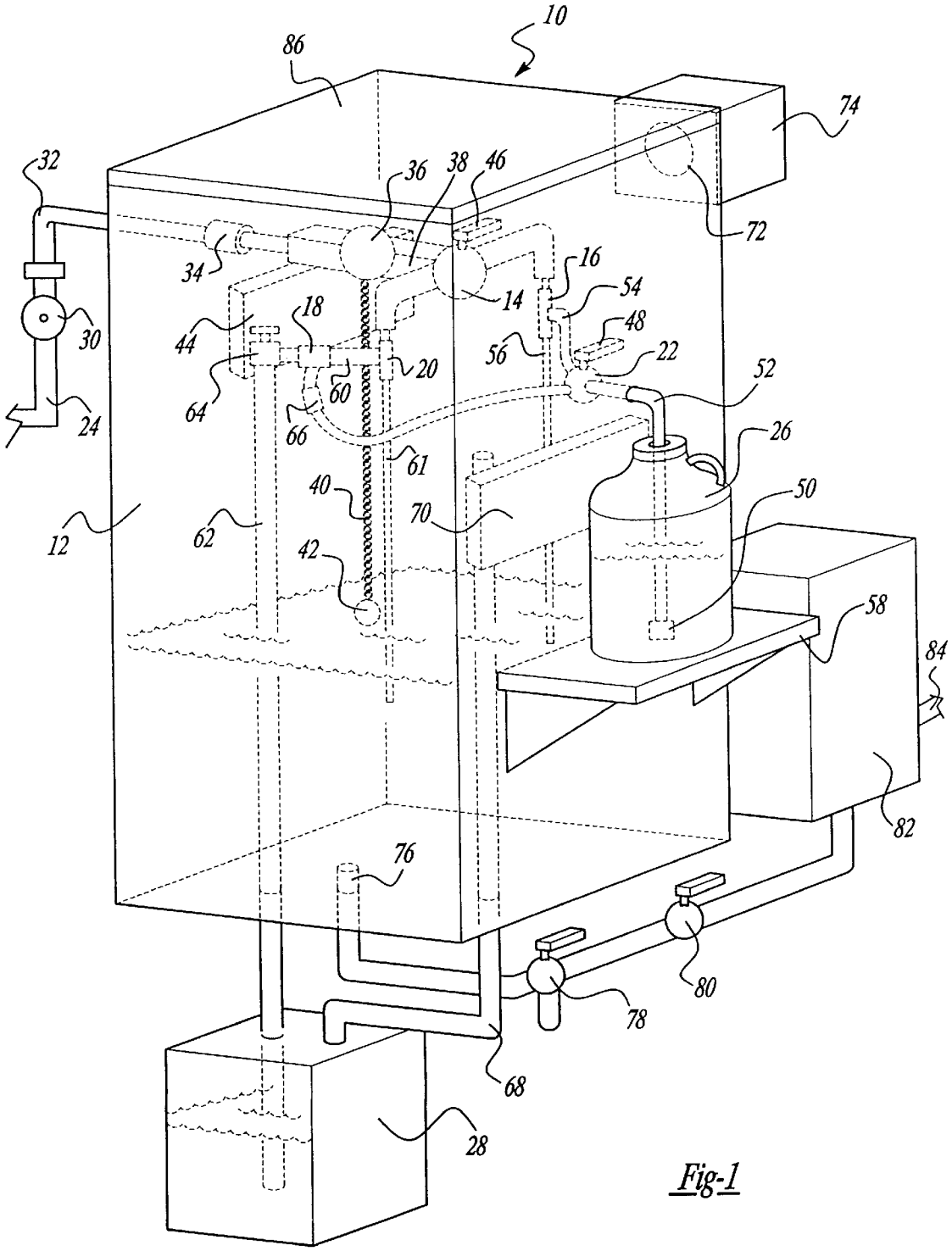
FIG. 1 is a perspective view of a system for mixing bulk windshield washer liquid for both cold and warm climates in accordance with this invention.

A system for mixing bulk windshield washer liquid for both cold and warm climates in accordance with this invention is shown in FIG. 1 and is generally designated by reference number 10. Major components of mixing system 10 include a housing 12, a three way water valve 14, a first high concentrate educator 16, a second high concentrate eductor 18, a high volume eductor 20, and a three way detergent valve 22.

In the warm weather mode, the three way water valve 14 directs water received from a water supply hose 24 to the first high concentrate eductor 16 and the three way detergent valve 22 is set to direct detergent received from a detergent storage container 26 to the first high concentrate educator 16. The flow of water through the first high concentrate eductor 16 withdraws metered quantities of detergent into the eductor. The water and detergent mix in the first high concentrate eductor 16 to create the warm weather mix which is then discharged into a holding tank formed by the housing 12.

In the cold weather mode, the three way water valve 14 directs water received from the water supply hose 24 to the high volume eductor 20 and the three way detergent valve 22 directs detergent received from detergent storage container 26 to the second high concentrate eductor 18. The flow of water through the high volume eductor 20 withdraws metered quantities of alcohol/detergent mixture which is produced by the second high concentrate eductor 18. The flow of alcohol/detergent mixture out of the second high concentrate eductor 18 withdraws alcohol from the alcohol storage container 28 and also withdraws metered quantities of detergent from the detergent storage container 26.

Water is supplied to the mixing system 10 from the water supply hose 24, which is typically attached to the potable water supply system in the motor vehicle service center in which the mixing system 10 is installed. The water supply hose 24 is typically attached to the mixing system 10 using a water shut off valve 30 and a water supply line 32. The water supply line 32 is connected to coupling 34 which spans housing 12. To function properly, the cross-sectional diameter of the water supply hose 24 and water supply line 32 must be matched to the cross-sectional diameter of the related components within the housing 12. In one embodiment of the mixing system 10, three quarter inch (¾") plumbing components are used.

Water entering housing 12 passes through a float valve 36, a check valve 38, and the three way water valve 14. The lower section of housing 12 defines a holding tank for the windshield washer liquid mixture and the float valve 36 uses a chain 40 and a float 42 to maintain an essentially constant level of windshield washer liquid mixture within the holding tank. A float valve 36 of the type sold under the tradename "HYDROMINDER™" is preferred for the embodiment of the inventive mixing system 10 shown in FIG. 1. A first bracket 44 is rigidly fixed to housing 12 and this bracket supports float valve 36 and other components of the mixing system 10 located within the housing 12, such as the three way water valve 14. The housing 12 may be fabricated from any relatively strong material that is impervious to the windshield washer liquid mixture, such as stainless steel. Housing 12 is typically mounted to a wall or similar support structure of a motor vehicle service center.

A water supply control handle 46, connected to the three way water valve 14, allows water supplied by the water supply hose 24 to be alternatively directed toward the first high concentrate eductor 16 or the high volume educator 20 and thus acts as a means for selectively actuating either the first high concentrate eductor 16 or the high volume educator 20.

A detergent supply control handle 48, connected to the three way detergent valve 16, allows detergent supplied from detergent storage container 26 to be alternatively directed toward the first high concentrate eductor 16 or the second high concentrate eductor 18.

When the water supply control handle 46 and the detergent supply control handle 48 are in the "warm weather" position, water is directed through the high concentrate eductor 16 and this draws detergent from the detergent storage container 26 into the eductor by the venturi effect. The detergent is drawn from the detergent storage container 26 through a check valve 50 and a detergent supply hose 52. The check valve 50 also has a filter that prevents contaminates, such as dye particles, from blocking the extremely small orifice in the metering tip of the first high concentrate eductor 16. An elbow 54 in the detergent supply hose 52 at the point the detergent supply hose is joined to the first high concentrate eductor 16 inhibits inadvertent siphoning of the detergent and the formation of air pockets in the detergent supply hose. After the water and detergent mix in the first high concentrate eductor 16, the water/detergent mixture is discharged into the housing by a first discharge pipe 56. The first high concentrate eductor 16 acts as a first concentrate mixer and mixes detergent concentrate with water at a first concentrate/water ratio to form the windshield washer liquid warm weather formulation.

As shown in FIG. 1, detergent storage container 26 can be conveniently located adjacent to housing 12 on a shelf 58 connected to the housing 12. The shelf 58 may include a collar or recessed area in which the bottom of the detergent storage container 26 sits, to prevent the container from being accidentally dislodged from the shelf. Detergent supply hose 52 is typically connected to a fitting that joins three way detergent valve 22 to the housing 12. To reduce the possibility of leakage of liquids or vapors, threaded fittings can be used at each point a conduit passes into the housing 12.

To switch from the "warm weather" mode to the "cold weather" mode, the water supply control handle 46 is merely repositioned to direct water toward the high volume eductor 20 and the detergent supply control handle 48 is merely repositioned to direct detergent toward the second high concentrate eductor 18. When water is directed through the high volume eductor 20 by the three way water valve 14, a mixture of alcohol and detergent is drawn by the venturi effect through an alcohol/detergent line 60. The cold weather mix is discharged from the high volume eductor 20 to the housing 12 through a second discharge pipe 61. The second discharge pipe 61 may be a suitable length of flexible tubing that allows the free end to be removed from the housing and allows a sample of cold weather mix to be taken by the operator of the mixing system 10. A loop may be formed in the alcohol/detergent line 60 between the second high concentrate eductor 18 and the high volume educator 20 with the center of the loop located below both of the eductors to prevent inadvertent siphoning and the formation of air pockets in the alcohol/detergent line. The withdrawal of the alcohol/detergent mixture through alcohol/detergent supply line 60 by high volume eductor 20 withdraws alcohol from alcohol storage container 28 through alcohol supply line 62. The alcohol passes through an adjustable metering valve 64 before it reaches the second high concentrate eductor 18 to provide the ability to more precisely regulate the quantity of alcohol being added to the water. The flow of alcohol through the second high concentrate eductor 18 withdraws detergent by the venturi effect from the detergent storage container 26. A detergent check valve 66 is placed between the three way detergent valve 22 and the second high concentrate educator 18 to inhibit alcohol from migrating down the detergent supply hose. In this system, the high volume eductor 18 acts as a second concentrate mixer that mixes alcohol and detergent with water at a second concentrate/water ratio.

The alcohol storage container 28 may be located on the floor below the mixing system 10. As can be expected from the discussion above, the quantity of alcohol required to produce a "cold weather" formulation can be orders of magnitude greater than the quantity of detergent required. Alcohol, for instance, may be utilized in 55 gallon drum quantities while the detergent concentrate may, for instance, be purchased in one gallon plastic jugs.

Alcohol supply line 62 may consist of three separate pieces of tubing. A first piece of tubing can be inserted into the bottom of alcohol storage container 26 and can terminate at the top of the container. A second piece of tubing can join the metering valve 64 and a fixture located on the bottom of the housing 12. A third piece of tubing can contain quick connect/disconnect fittings that allow the first and second pieces of tubing to be joined. These fittings are preferably of the type that prevent alcohol from leaking from the fittings or from the tubing when either end of the third piece of tubing is disconnected from one of the other pieces.

Because the alcohol used to produce windshield washer liquid is typically a flammable hazardous material that is volatile at room temperature, such as methanol, it is important that the alcohol storage container 28 be sealed to limit the danger of fire, to prevent worker exposure to the hazardous constituents of the concentrate, and to limit the loss of the alcohol due to evaporation.

To allow air to enter the alcohol storage container 28 as the alcohol is withdrawn from the container, a vent pipe 68 is connected to another opening in the top of alcohol storage container 28. The vent pipe 68 connects air in the headspace on the top of the alcohol storage container 28 with the headspace above the windshield washer liquid in the housing 12. The upper end of the vent pipe 68 is supported within the housing 12 by a second bracket 70. The vent pipe 68 also acts as a pressure relief device in the event that the pressure within the alcohol storage container 28 exceeds atmospheric pressure.

As discussed above with respect to the alcohol supply line 62, the vent pipe 68 could consist of two separate pieces. A first piece can remain within the housing 12 and can terminate at a fitting located on the bottom of the housing 12. A second piece with quick connect/disconnect fittings could be used to connect the fitting on the bottom of the housing 12 to a fixture screwed into an opening on the top of the alcohol storage container 28. If the vent pipe 68 and the alcohol supply line 62 incorporate these quick connect/disconnect fixtures, one line can utilize two male fixtures while the other line can utilize two female fixtures to prevent the operator from mistakenly switching the lines used to connect the alcohol storage container 28 to the housing 12.

The fumes caused by the evaporation of the windshield washer liquid in the housing 12 and the evaporation of the alcohol in alcohol storage container 28 (and which entered the housing through vent pipe 68) primarily exit the housing 12 through an aperture 72 where they then enter an activated charcoal filter 74. The activated charcoal filter 74 neutralizes any alcohol fumes before they are discharged into the building in which the mixing system 10 is installed. The air leaving activated charcoal filter 74 can either be discharged into the building or can be directed outside the building in which the mixing system 10 is installed.

The windshield washer liquid within the housing 12 is withdrawn through a drain pipe 76. The drain pipe 76 is connected to a drain valve 78, a shut off valve 80 and a pump 82. If, for whatever reason, the pump 82 is inoperable, the shut off valve 80 can be closed and the drain valve 78 can be used to withdraw windshield washer liquid from the housing 12 and place it into dispensing containers such as plastic jugs. As discussed above, electricity is not required to operate the mixing system 10 and the system can properly mix windshield washer liquid whenever there is sufficient water pressure and adequate quantities of detergent and alcohol.

The pump 82 withdraws the windshield washer liquid mixture from the housing 12 and discharges it through a discharge hose 84 which is used by a vehicle maintenance technician to dispense the windshield washer liquid into the motor vehicle being serviced. The pump 82 is preferably air operated, such as a Wilden air operated double diaphragm pump, that can be connected to the pressurized air supply system in the motor vehicle service center. These types of pumps are quite, have extremely limited vibration characteristics, and do not require electrical connections that could be ignition sources for any flammable materials. This type of pump can be actuated simply by a drop in pressure in the discharge hose 84. As a service technician dispenses windshield washer liquid from the discharge hose 84, the pump 82 senses the drop in pressure and automatically repressurizes the liquid in the discharge hose. The drain pipe 76, the pump 82, and the discharge hose 84 acts as a windshield washer liquid conduit to convey the windshield washer liquid produced by the eductors 16 and 20 and allows the windshield washer liquid to be dispensed into motor vehicles during servicing.

While pump 82 and activated charcoal filter 74 are shown being positioned behind housing 12 for ease of illustration, the pump 82 is preferably mounted on the housing below the detergent storage container 26 and the activated charcoal filter 74 is preferably mounted above the detergent storage container, allowing the back of the mixing system 10 to be mounted flush to the wall of the building in which it is installed.

Housing 12 includes a hinged cover 86 which closes off the housing and limits the evaporation of the windshield washer liquid mixture, but also allows access to the internal components of mixing system 10. A gasket-type material can be used between the cover 86 and the housing 12 to produce an essentially air-tight seal between these components.

When the mixing system 10 is used, the windshield washer liquid mixture level in the housing 12 will be automatically regulated by the float valve 36. When the level in housing 12 falls below a certain point as the windshield washer liquid is dispensed from the mixing system 10, the float valve 36 allows water to flow into the three way water valve 14. Depending on the position of the water supply control handle 46, the water will be diverted to either the first high concentrate eductor 16 or to the high volume educator 20. The water passing through the applicable eductor will be mixed with the appropriate type of concentrate and then discharged into the housing 12. The concentrate/water mixture in the housing 12 is withdrawn from the housing by the pump 82 through the drain pipe 76 and then discharged through the discharge hose 84 where it can be dispensed into motor vehicles by an automotive service technician.

As the concentrate container being used is emptied, i.e. the detergent storage container 26 or the alcohol storage container 28, the operator merely removes the supply line (and the vent pipe in the case of the alcohol storage container), removes the empty container, place a full container of the proper concentrate in the proper position and reconnects the supply line (and the vent pipe in the case of the alcohol storage container).

If the metering tips in the first high concentrate eductor 16, the second high concentrate educator 18, the high volume eductor 20, and the metering valve 64 are properly adjusted, the only action required to switch the mixing system 10 from the warm weather mode to the cold weather mode, or vice versa, is to reposition the water supply control handle 46 connected to the three way water valve 14 and the detergent supply control handle 48 connected to the three way detergent valve 22 to their opposite positions and to make sure that containers having the appropriate materials are properly connected to the mixing system 10.

The applicant believes that cold weather formulation windshield washer liquid can be self mixed for approximately half of the cost of purchasing equivalent premixed windshield washer liquid in bulk. These cost benefits are in addition to the time savings, space savings, and operational benefits of the mixing system 10. The cost of mixing warm weather formulation windshield washer liquid utilizing the inventive mixing system 10 can easily be only pennies per gallon, a fraction of the cost of purchasing premixed windshield washer liquid.

It is to be understood that the invention is not limited to the exact construction illustrated and described above, but that various changes and modifications may be made without departing from the spirit and scope of the invention as defined in the following claims.

I claim:

1. A system for mixing bulk windshield washer liquid for both cold and warm climates utilizing a first container having a first type of windshield washer concentrate, a second container having a second type of windshield washer concentrate and a water supply source, said system comprising:

a water conduit for conveying water from the water supply source, a first mixer, connected to the water conduit, for withdrawing the first type of windshield washer concentrate from the first container and mixing the first type of windshield washer concentrate with water from the water conduit to create windshield washer liquid at a first concentrate/water ratio, a second mixer, connected to the water conduit, for withdrawing a mixture of the first type of windshield washer concentrate and the second type of windshield washer concentrate and mixing the concentrates with the water from the water conduit to create windshield washer liquid at a second concentrate/water ratio, a third mixer connected to the second mixer for withdrawing the first type of windshield washer concentrate from the first container and withdrawing the second type of windshield washer concentrate from the second container that mixes the first type of windshield washer concentrate and the second type of windshield washer concentrate and that provides the mixture of the concentrates to the second mixer, windshield washer liquid conduit means, connected to the first mixer and the second mixer, for receiving the windshield washer liquid discharged from the first mixer and the second mixer and allowing the windshield washer liquid to be dispensed, and means for selectively actuating said first mixer and said second mixer.

2. The system according to claim 1, wherein said first mixer comprises a high concentrate eductor that mixes the water with the first type of windshield washer concentrate and the first type of windshield washer concentrate is a detergent concentrate.

3. The system according to claim 1, wherein said second mixer comprises a high volume eductor that mixes the water with the mixture of the first type of windshield washer concentrate and the second type of windshield washer concentrate and the first type of windshield washer concentrate is a detergent concentrate and the second type of windshield washer concentrate is alcohol.

4. The system according to claim 1, wherein said means for selectively actuating said first mixer and said second mixer comprises a three way water valve.

5. The system according to claim 1, further comprising a float valve positioned between said water conduit and said means for selectively actuating said first mixer and said second mixer, said float valve regulating the quantity of windshield washer liquid maintained within said windshield washer liquid conduit means.

6. The system according to claim 1, further comprising a supply line joining said second mixer and said second container and a metering valve located within said supply line.

7. The system according to claim 1, further comprising a vent pipe that allows air to enter and exit said second container.

8. The system according to claim 1, wherein said windshield washer liquid conduit means includes a drain valve that allows windshield washer liquid to be drained from the windshield washer liquid conduit means.

9. The system according to claim 1, wherein said windshield washer liquid conduit means includes an air driven pump.

10. A system for mixing bulk windshield washer liquid for both cold and warm climates utilizing a first container containing a detergent concentrate, a second container containing alcohol, and a water supply source, said system comprising:

a first high concentrate eductor that mixes water from said water supply source and detergent concentrate from said first container, a second high concentrate eductor that mixes detergent from said first container and alcohol from said second container, a high volume eductor connected to said second high concentrate eductor that mixes water from said water supply source and the detergent and alcohol mixture from said second high concentrate eductor, and a water valve, connected to said first high concentrate eductor and said high volume eductor, that selectively directs water from the water supply source through said first high concentrate eductor and said high volume eductor.

11. The system according to claim 10, further including a detergent valve that selectively directs detergent to said first high concentrate eductor and said second high concentrate eductor.

12. The system according to claim 10, further including a float valve between said water supply source and said water valve that controls the flow of water into said water valve.

13. The system according to claim 10, further including a check valve between said water supply source and said water valve that inhibits alcohol and detergent concentrate from entering said water supply source.

14. The system according to claim 10, further including a housing for receiving the mixed water and detergent concentrate from said first high concentrate eductor and the mixed water and alcohol from said high volume eductor.

15. The system according to claim 10, further including an air driven pump for dispensing the mixed water and detergent concentrate from said first high concentrate eductor and the mixed water and alcohol from said high volume eductor.

16. The system according to claim 10, further including a metering valve between said high volume eductor and said second container.

17. A system for mixing bulk windshield washer liquid for both cold and warm climates utilizing a first container containing a detergent concentrate, a second container containing alcohol, and a water supply source, said system comprising:

a housing, a first high concentrate eductor, connected to said housing, that mixes water from said water supply source and detergent concentrate from said first container and discharges the water/detergent concentrate mixture into said housing, a high volume eductor, connected to said housing, that mixes water from said water supply source and alcohol from said second container and discharges the water/alcohol mixture into said housing, a water valve, connected to said first high concentrate eductor and to said high volume eductor, that selectively directs water from the water supply source through said high concentrate eductor and said high volume eductor, a second high concentrate eductor, connected to said high volume eductor, that mixes detergent concentrate from said first container and alcohol from said second container and directs said alcohol/detergent concentrate mixture to said high volume eductor, and an air operated pump, connected to said housing, that dispenses the water/detergent concentrate mixture and the water/alcohol mixture from said housing.

18. The system according to claim 14, further including a valve responsive to the volume of windshield washer liquid in said housing for regulating water flow from the water supply source.

19. The system according to claim 18, wherein said valve is a float valve.

20. The system according to claim 14, wherein at least one of said first high concentrate eductor, said second high concentrate eductor, said high volume eductor, said valve that directs water through said first high concentrate eductor and said high volume eductor or said valve that regulates flow from the water source is located in said housing.

21. The system according to claim 14, further including a a filter connected to said housing and said second container through which vapors from said housing and said second container are vented.

22. A system for mixing bulk windshield washer liquid from a first type of windshield washer concentrate and a second type of windshield washer concentrate, the second type of windshield washer concentrate being a volatile, flammable liquid, and water from a water supply source, said system comprising:

a water conduit for conveying water from the water source;

a first container for holding the first type of windshield washer concentrate;

a second container for holding the second type of windshield washer concentrate, the second container being a sealed container from which a vent pipe extends;

a housing for containing the windshield washer liquid;

a first mixer, connected to the water conduit, for withdrawing the first type of windshield washer concentrate from said first container and mixing the first type of windshield washer concentrate with water from the water conduit to create windshield washer liquid at a first concentrate/water ratio and discharging the windshield washer liquid into the housing;

a second mixer, connected to the water conduit, for withdrawing the second type of windshield washer concentrate from said second container and mixing the second type of windshield water concentrate with water from the water conduit to create windshield washer liquid at a second concentrate/water ratio and discharging the windshield washer liquid into said housing;

a conduit connected to the housing for receiving the windshield washer liquid through which the windshield washer liquid is dispensed;

a filter connected to the housing and to said vent pipe for neutralizing fumes produced by the evaporation of the second type of windshield washer concentrate or the windshield washer liquid; and means for selectively activating the first mixer or the second mixer.

23. A system according to claim 22, wherein said second mixer further receives the first type of windshield washer concentrate so that said second mixer mixes a mixture of the first type of windshield washer concentrate and the second type of windshield washer concentrate with the water from the water conduit to create windshield washer at the second concentrate/water ratio.

24. The system according to claim 23, wherein a third mixer is connected to the second mixer for withdrawing the first type of windshield washer concentrate from said first container and withdrawing the second type of windshield washer concentrate from said second container and mixes the windshield washer concentrates together so as to produce the mixture of the first type of windshield washer concentrate and the second type of windshield washer concentrate and that provides the mixture of the concentrates to said second mixer.

25. The system for mixing bulk windshield washer liquid of claim 22, wherein: said vent pipe from the second container extends into said housing and opens into the housing; and said housing is formed with an opening through which vapor from said housing and said vent pipe are flowed to said filter.

26. The system for mixing bulk windshield washer liquid of claim 25, wherein:

said vent pipe opens into said housing at a first level; and a valve is attached to the water conduit and is at least partially located in said housing for controlling water flow through the conduit wherein, said valve prevents water flow through the conduit when the volume of the windshield washer liquid in the housing is at or above a second level, the second level being lower than the first level.

27. The system for mixing bulk windshield washer liquid of claim 22, wherein at least one of said first mixer, said second mixer or said means for selectively activating the first mixer or the second mixer is located in said housing.

* * * * *

UNITED STATES PATENT AND TRADEMARK OFFICE

CERTIFICATE OF CORRECTION

PATENT NO. : 6,065,863
DATED : May 23, 2000
INVENTOR(S) : William O. Cain

It is certified that error appears in the above-identified patent and that said Letters Patent is hereby corrected as shown below:

Column 11,
Line 15, change "14" to -- 18 --.

Column 12,
Line 18, after "washer" insert -- liquid --.
Line 24, change "mixes" to -- mixing --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*